US009414452B1

(12) United States Patent
Cheng et al.

(10) Patent No.: US 9,414,452 B1
(45) Date of Patent: Aug. 9, 2016

(54) LIGHT-EMITTING DIODE LIGHTING DEVICE WITH SYNCHRONIZED PWM DIMMING CONTROL

(71) Applicant: IML International, Grand Cayman (KY)

(72) Inventors: Kai-Yun Cheng, Taipei (TW); Yung-Hsin Chiang, New Taipei (TW)

(73) Assignee: IML International, Grand Cayman (KY)

( * ) Notice: Subject to any disclaimer, the term of this patent is extended or adjusted under 35 U.S.C. 154(b) by 0 days.

(21) Appl. No.: 14/994,122

(22) Filed: Jan. 12, 2016

Related U.S. Application Data

(60) Provisional application No. 62/104,087, filed on Jan. 16, 2015.

(51) Int. Cl.
*H05B 37/00* (2006.01)
*H05B 33/08* (2006.01)

(52) U.S. Cl.
CPC ..... *H05B 33/0824* (2013.01); *H05B 33/0851* (2013.01)

(58) Field of Classification Search
CPC ..... H05B 33/0824; H05B 33/0851; H05B 41/3927
USPC ..... 315/185 R, 186, 200 R, 291, 294, 297, 315/307
See application file for complete search history.

(56) References Cited

U.S. PATENT DOCUMENTS

| | | | | |
|---|---|---|---|---|
| 8,339,067 | B2 * | 12/2012 | Lin | H05B 33/0818 315/291 |
| 8,975,831 | B1 * | 3/2015 | Szolusha | H05B 33/0851 315/291 |
| 2009/0079355 | A1 * | 3/2009 | Zhou | H05B 33/0818 315/246 |
| 2009/0195168 | A1 * | 8/2009 | Greenfeld | H05B 33/0815 315/192 |
| 2012/0319621 | A1 * | 12/2012 | Sutardja | H05B 33/0815 315/307 |
| 2013/0193877 | A1 * | 8/2013 | Kuo | H05B 33/0818 315/307 |
| 2013/0300303 | A1 * | 11/2013 | Liu | H05B 33/0815 315/200 R |
| 2014/0091723 | A1 * | 4/2014 | Kuo | H05B 33/0857 315/200 R |
| 2015/0271882 | A1 * | 9/2015 | Melanson | H05B 33/0815 315/186 |

* cited by examiner

*Primary Examiner* — Jason M Crawford
(74) *Attorney, Agent, or Firm* — Winston Hsu; Scott Margo

(57) ABSTRACT

An LED lighting device includes a luminescent circuit, a detecting circuit, an adjustable current source and a dimming control circuit. The luminescent circuit is driven by a rectified AC voltage for providing light. The detecting circuit is configured to detect a rising edge or a falling edge of the LED current associated with a frequency of the rectified AC voltage. The dimming current regulator is configured to vary a duty cycle of the LED current according to a PWM signal. The dimming control circuit is configured to generate the PWM signal and synchronize a frequency of the PWM signal with the frequency of the rectified AC voltage at the detected rising edge or the falling edge of the rectified AC voltage.

10 Claims, 6 Drawing Sheets

LIGHT-EMITTING DIODE LIGHTING DEVICE WITH SYNCHRONIZED PWM DIMMING CONTROL

CROSS REFERENCE TO RELATED APPLICATIONS

This application claims the benefit of U.S. provisional application No. 62/104,087 filed on Jan. 16, 2015.

BACKGROUND OF THE INVENTION

1. Field of the Invention

The present invention is related to an LED lighting device, and more particularly, to an LED lighting device capable of providing synchronized PWM dimming control.

2. Description of the Prior Art

An LED lighting device directly driven by a rectified alternative-current (AC) voltage usually adopts a plurality of LEDs coupled in series in order to provide required luminance. LED lighting has been widely utilized in different application scenarios. To save energy or provide different brightness, dimming technologies have also been developed so that the lighting can be dimmed in different situations. Traditionally, there are different categories of dimming methods, including pulsed width modulation (PWM) dimming and analog dimming. Analog dimming changes LED light output by directly adjusting the DC current in the LED string, while PWM dimming achieves the same effect by varying the duty cycle of a constant current in the LED string to effectively change the average current in the LED string. A user may be provided with a means to control the LED dimming.

In the prior art, PWM dimming may be achieved by periodically switching on and off the LED current according to a PWM signal. The duty cycle of the LED current may thus be adjusted, thereby changing the overall luminance of an LED lighting device. However, if the frequency of the PWM signal is not synchronized with the frequency of the rectified AC voltage, the waveform of the LED current may vary during different cycles of the rectified AC voltage, thereby causing flicker or shimmer. LED flicker or shimmer, whether perceptible or not, has been a concern of the lighting community because of its potential human impacts, which range from distraction, mild annoyance to neurological problems. Therefore, there is a need for an LED lighting device capable of providing synchronized PWM dimming control.

SUMMARY OF THE INVENTION

The present invention provides an LED lighting device which includes a luminescent circuit, an adjustable current source, a detecting circuit, and a dimming control circuit. The luminescent circuit is driven by a rectified AC voltage for providing light. The adjustable current source is configured to vary a duty cycle of the LED current according to a PWM signal. The dimming control circuit is configured to generate the PWM signal and synchronize a frequency of the PWM signal with the frequency of the rectified AC voltage at the detected rising edge or the falling edge of the rectified AC voltage.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
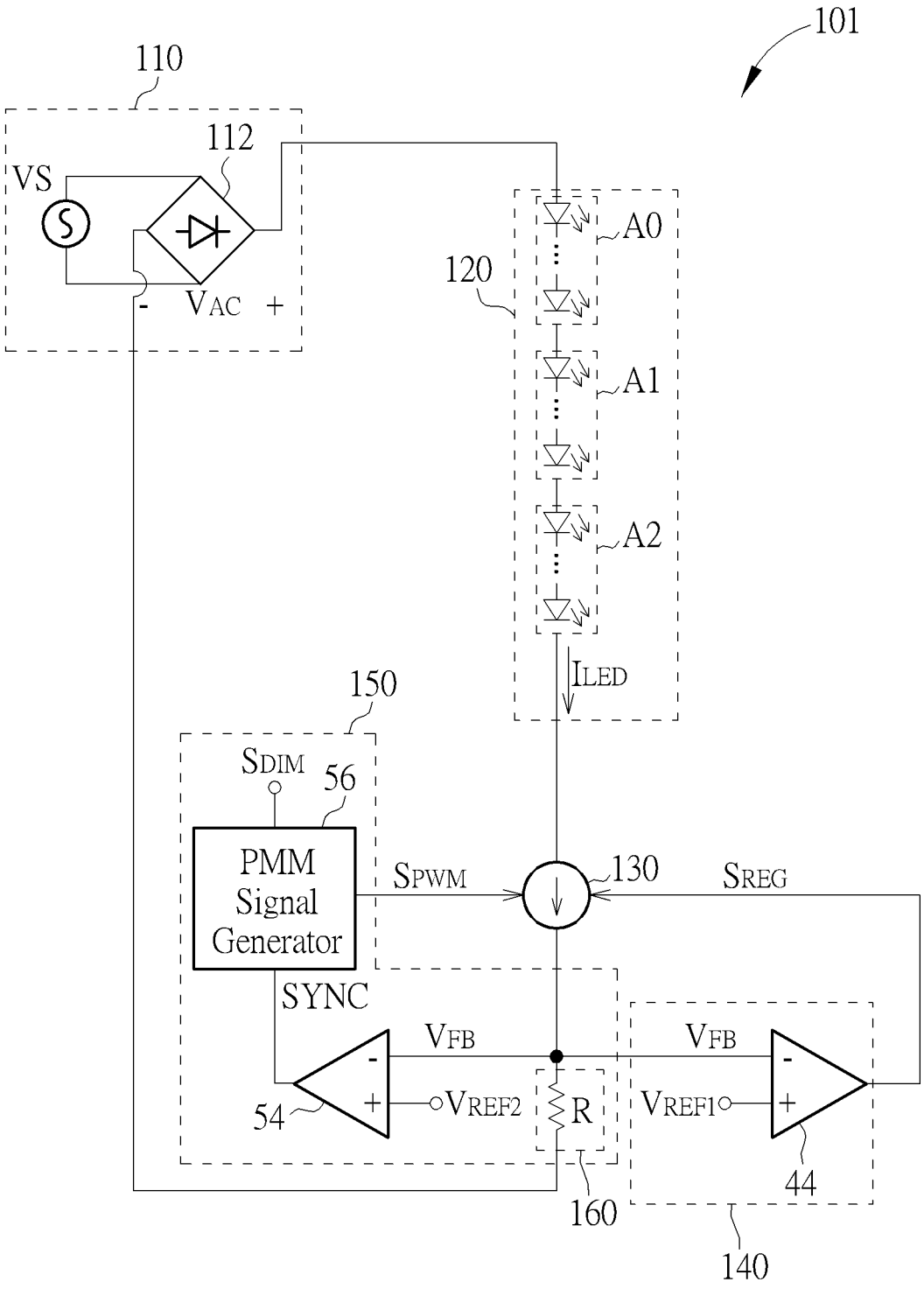
FIG. 1 is a diagram illustrating an LED lighting device according to an embodiment of the present invention.
Figure 2:
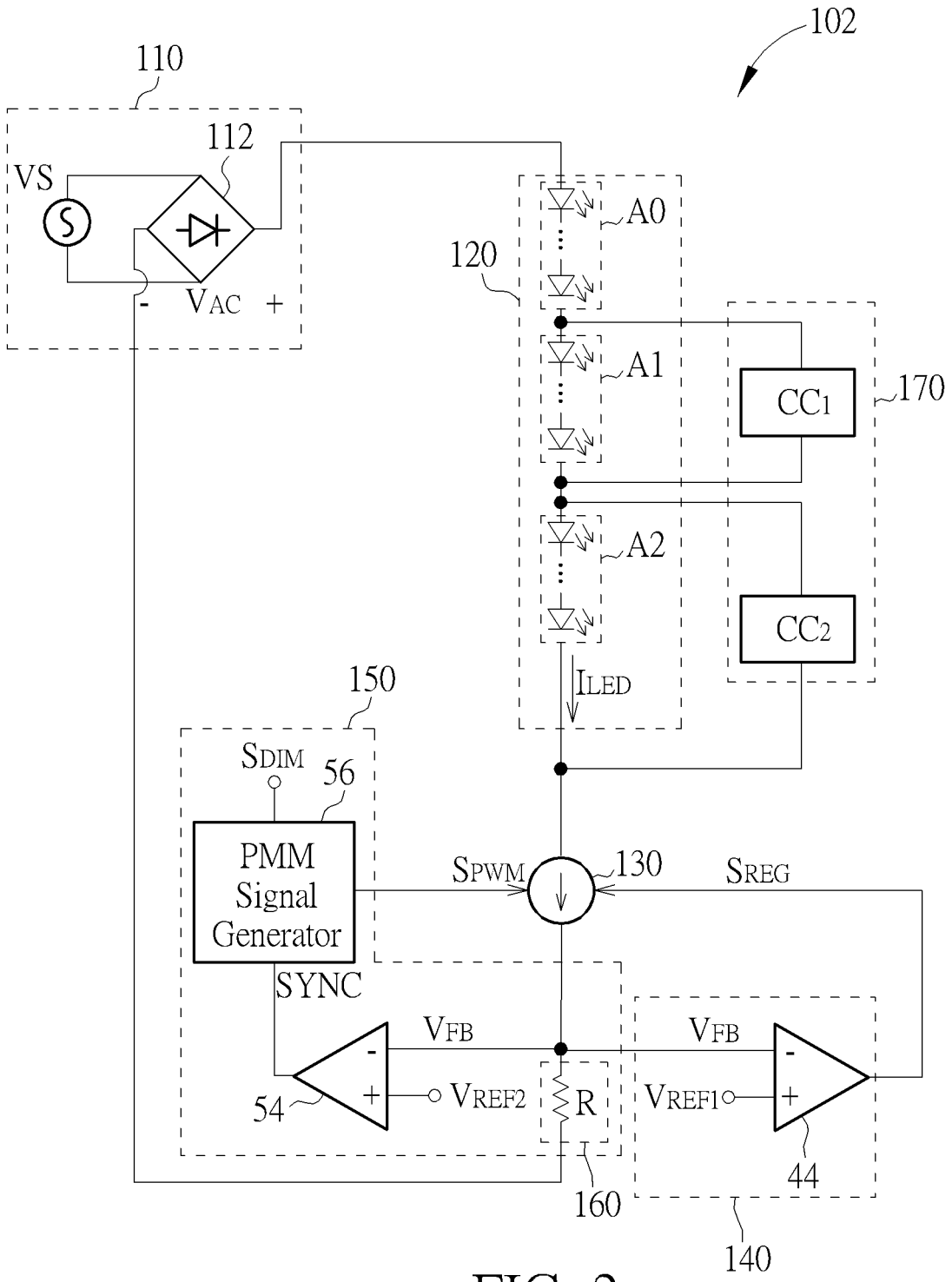
FIG. 2 is a diagram illustrating an LED lighting device according to another embodiment of the present invention.
Figure 3:
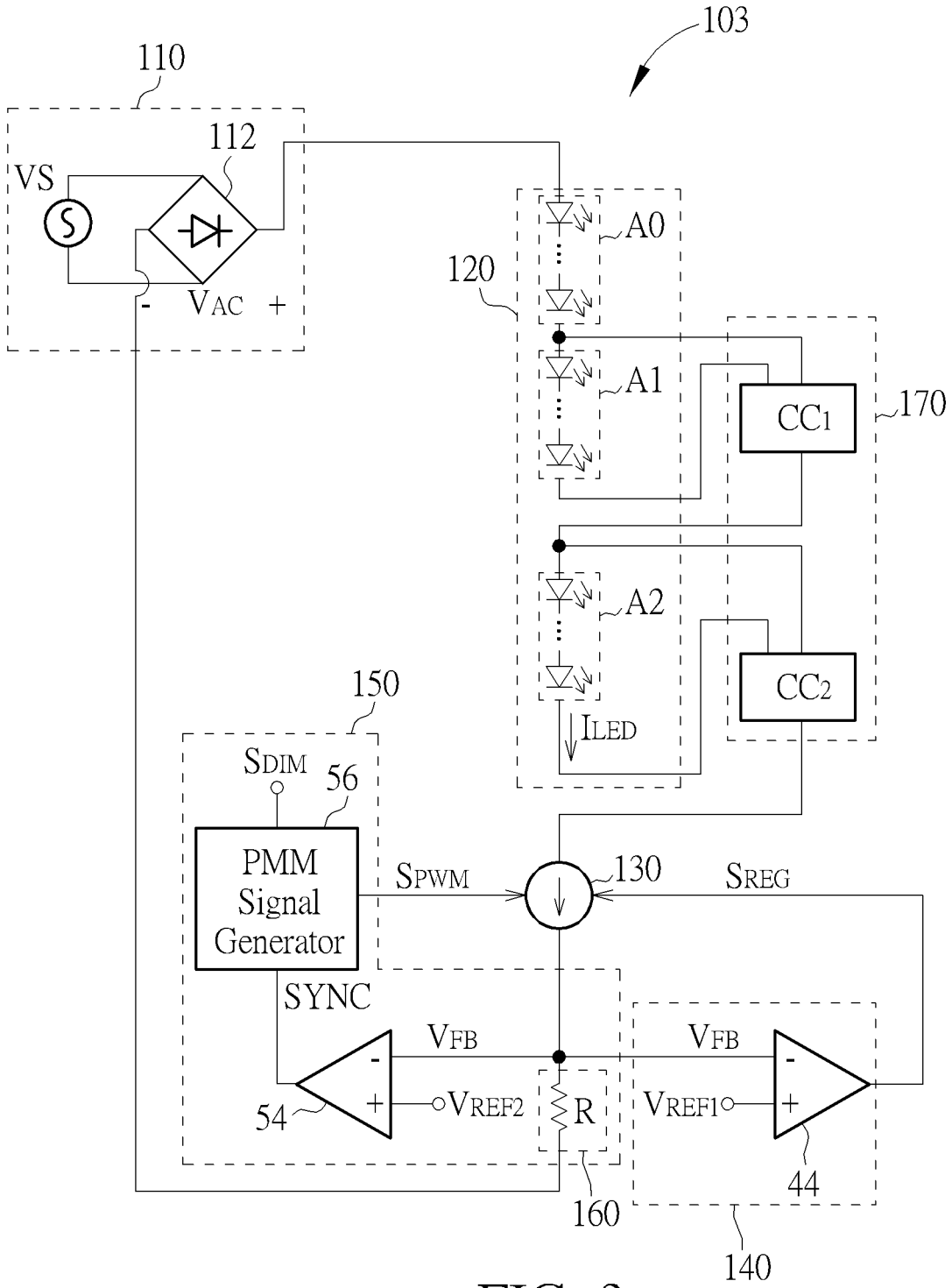
FIG. 3 is a diagram illustrating an LED lighting device according to another embodiment of the present invention.

FIGS. 1-3 are diagrams illustrating LED lighting devices 101~103 according to embodiments of the present invention. Each of the LED lighting devices 101~103 includes a power supply circuit 110, a luminescent circuit 120, an adjustable current source 130, a regulating control circuit 140, a dimming control circuit 150, and a detecting circuit 160. Each of the LED lighting devices 102~103 further includes a driving circuit 170. The power supply circuit 110 is configured to receive an AC voltage VS having positive and negative periods and convert the output of the AC voltage VS in the negative period using a bridge rectifier 112, thereby providing a rectified AC voltage $V_{AC}$, whose value varies periodically with time, for operating the luminescent circuit 120. In another embodiment, the power supply circuit 110 may receive any AC voltage VS, perform voltage conversion using an AC-AC converter, and rectify the converted AC voltage VS using the bridge rectifier 112, thereby providing the rectified AC voltage $V_{AC}$ whose value varies periodically with time. However, the configuration of the power supply circuit 110 does not limit the scope of the present invention.

In the present invention, the luminescent circuit 120 may include multiple luminescent devices $A_0$~$A_N$ (N is a positive integer), each of which may adopt a single LED or multiple LEDs coupled in series. FIGS. 1~3 depict the embodiment of N=2 using multiple LEDs which may consist of single-junction LEDs, multi-junction high-voltage (HV) LEDs, or any combination of various types of LEDs. However, the types and configurations of the luminescent circuit 120 do not limit the scope of the present invention.

In the present invention, the driving circuit 170 is configured to regulate the LED current $I_{LED}$ flowing through the luminescent circuit 120 in multiple stages. In the LED lighting device 102 depicted in FIG. 2, the driving circuit 170 includes M current controller $CC_1$~$CC_M$ each coupled in parallel to M luminescent devices among the luminescent devices $A_1$~$A_N$ of the luminescent circuit 120, respectively. In the LED lighting device 103 depicted in FIG. 3, the driving circuit 170 includes M current controller $CC_1$~$CC_M$ each having a first end coupled to a first end of a corresponding luminescent device among the luminescent devices $A_1$~$A_N$ of luminescent circuit 120, a second end coupled to a second end of the corresponding luminescent device, and a third end coupled to a first end of another luminescent device among the luminescent devices $A_1$~$A_N$ of luminescent circuit 120. In the present invention, M is a positive integer which does not exceed N. FIGS. 2 and 3 depict the embodiment when M=N=2. However, the configuration of the driving circuit 170 does not limit the scope of the present invention.

Since the LED current $I_{LED}$ flowing through the LED lighting devices 101~103 is associated with the rectified AC voltage $V_{AC}$ whose value varies periodically with time, the rising edge and the falling edge of the LED current $I_{LED}$ are related to the frequency of the rectified AC voltage $V_{AC}$, and the value of the LED current $I_{LED}$ is related to the level of the rectified AC voltage $V_{AC}$. In an embodiment of the present invention, the detecting circuit 160 may include a resistor R coupled in series to the adjustable current source 130 for providing a feedback voltage $V_{FB}$ associated with the rising edge or the falling edge of the LED current $I_{LED}$, as well as associated with the level of the rectified AC voltage $V_{AC}$. However, the configuration of the detecting circuit 160 does not limit the scope of the present invention.

In the present invention, the adjustable current source 130 is coupled in series to the luminescent circuit 120 and operates based on a regulating signal $S_{REG}$ and a PWM signal $S_{PWM}$. In an embodiment, the adjustable current source 130 may be implemented using an N-type metal-oxide-semiconductor (NMOS) transistor and/or one or multiple devices providing similar function. However, the configuration of the adjustable current source 130 does not limit the scope of the present invention. The adjustable current source 130 may be turned on or turned off by the PWM signal $S_{PWM}$, thereby varying the duty cycle of the LED current $I_{LED}$. The value of the adjustable current source 130 may be adjusted based on the regulating signal $S_{REG}$.

In the present invention, the regulating control circuit 140 includes a comparator 44. The comparator 44 is configured to compare the levels of the voltage $V_{FB}$ with a reference voltage $V_{REF1}$, thereby outputting the regulating signal $S_{REG}$ accordingly. If the regulating signal $S_{REG}$ indicates that $V_{FB}<V_{REF1}$, the adjustable current source 130 may increase its value; if the regulating signal $S_{REG}$ indicates that $V_{FB}>V_{REF1}$, the adjustable current source 130 may decrease its value. Therefore, if the rectified AC voltage $V_{AC}$ somehow fluctuates, the LED current $I_{LED}$ may be kept at a constant value.

In the present invention, the level of the PWM signal $S_{PWM}$ is associated with the amount of dimming selected by a user. The user may adjust the brightness of the LED lighting devices 101~103 using various types of dimmer switches including, but not limited to, rotary, paddle, slider and wireless switches. However, the means of providing dimming control to the user does not limit the scope of the present invention.

In the present invention, the dimming control circuit 150 includes a comparator 54 and a PWM signal generator 56. The PWM signal generator 56 is configured to provide the PWM signal $Sp_{PWM}$ according to a dimming signal $S_{DIM}$ and a synchronization signal SYNC.

Figure 4:
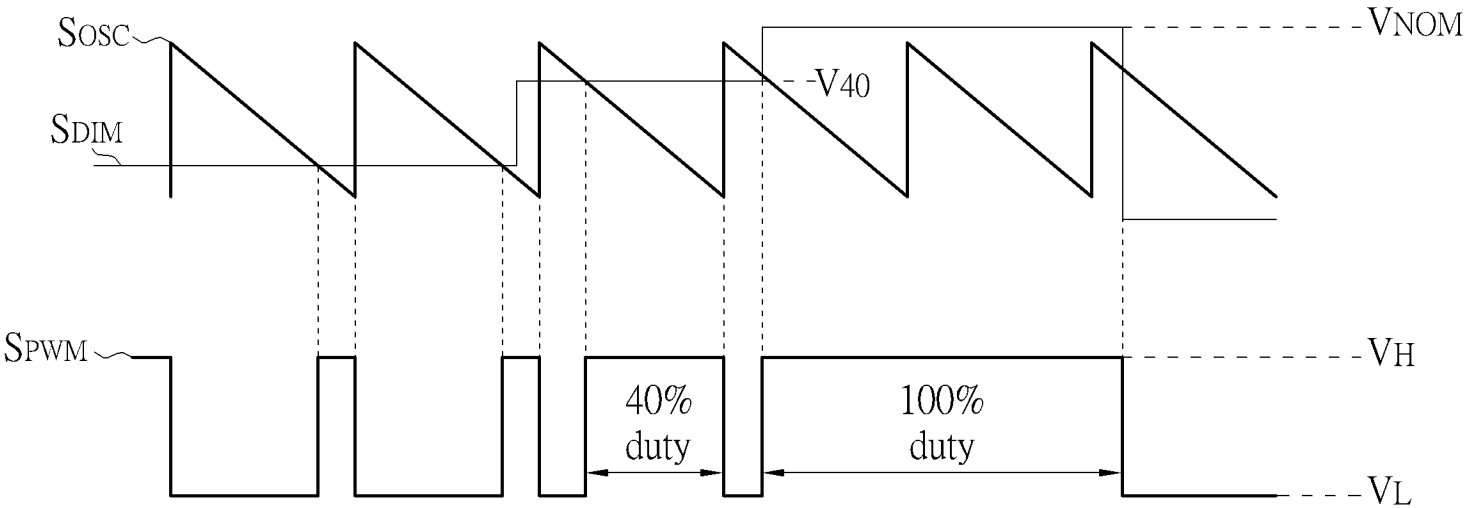
FIG. 4 is a diagram illustrating the operation of a dimming control circuit according to the present invention.
Figure 5:
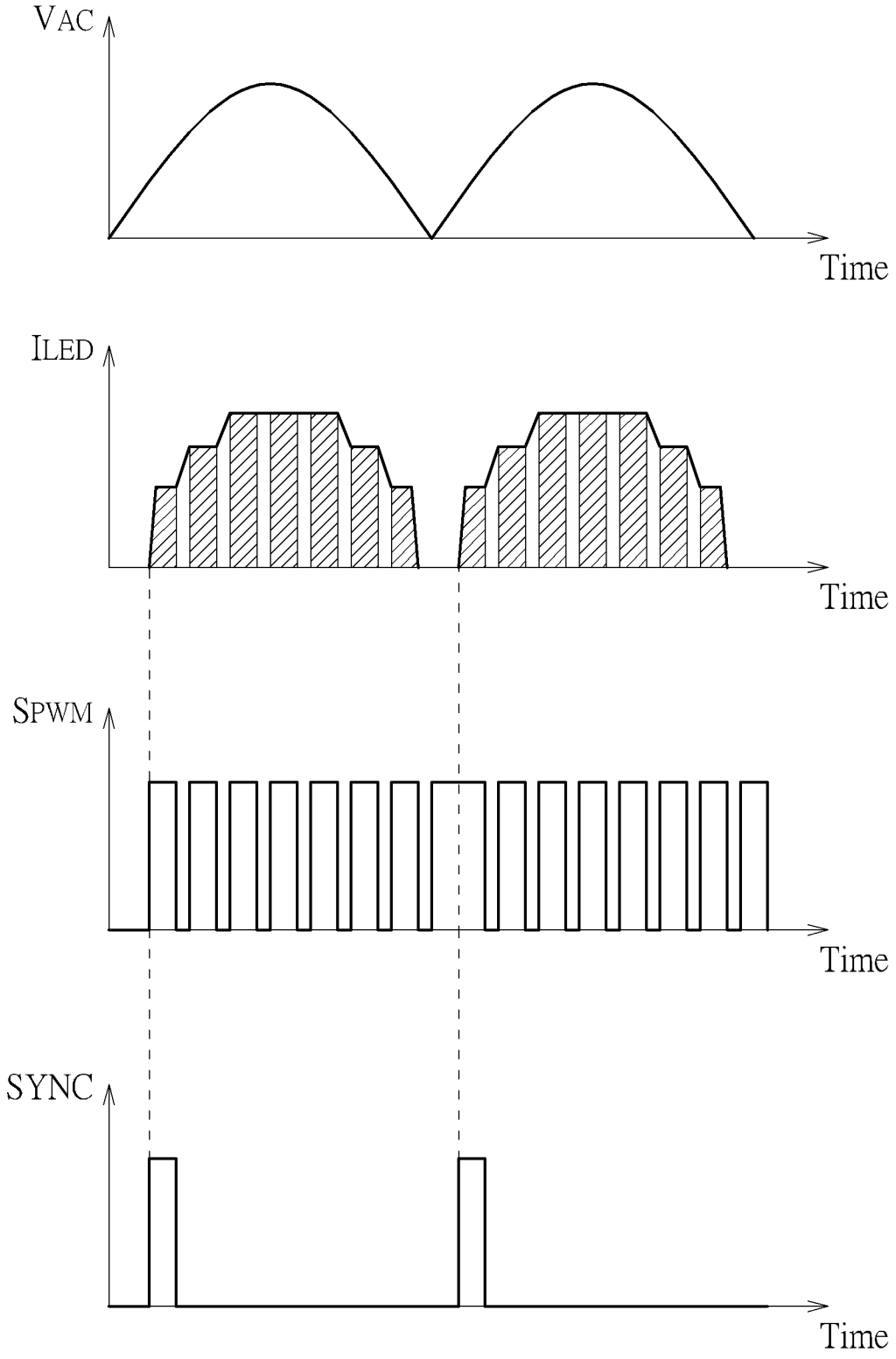
FIG. 5 is a diagram illustrating the operation of a dimming control circuit according to the present invention.
Figure 6:
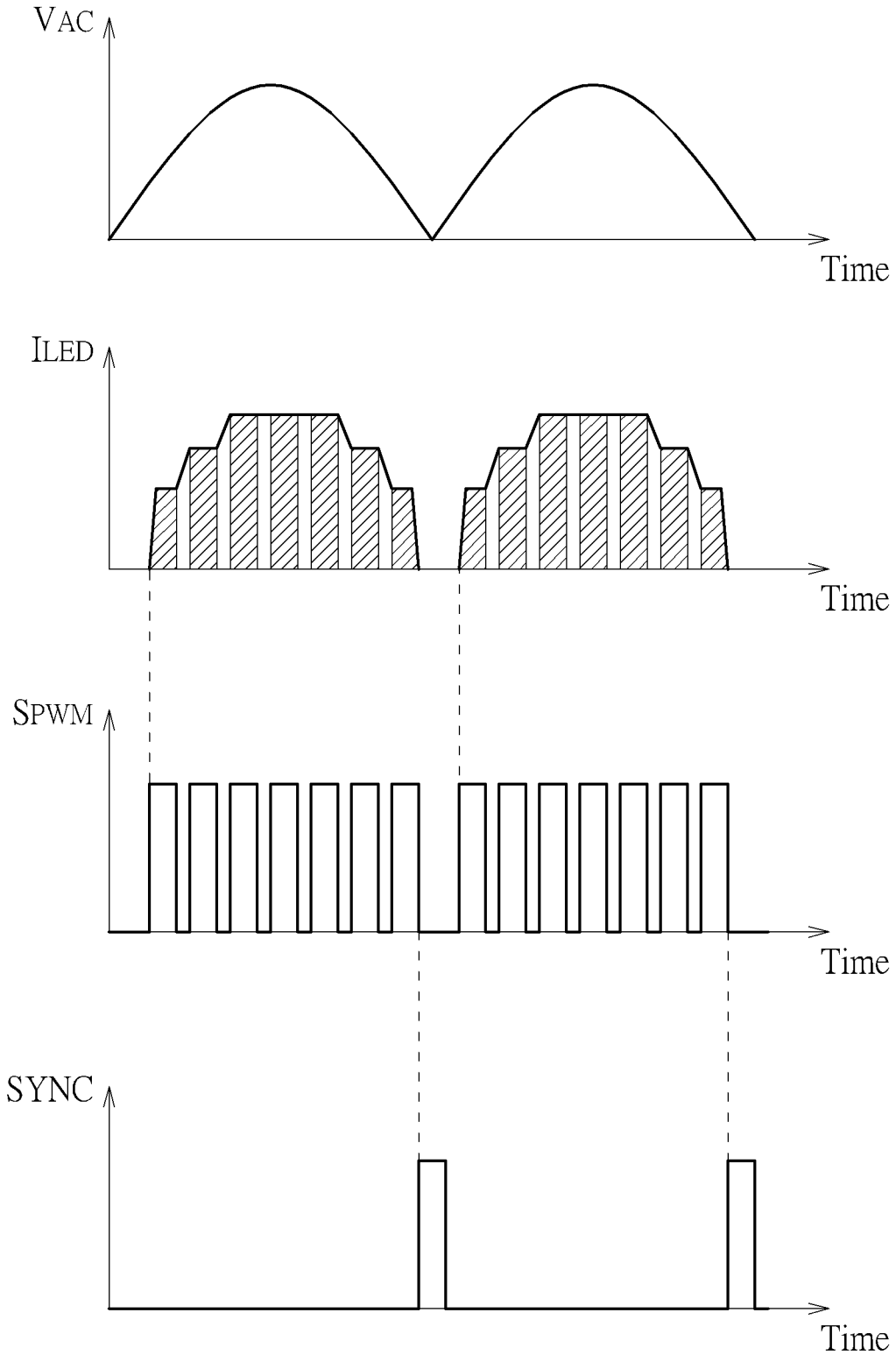
FIG. 6 is a diagram illustrating the operation of a dimming control circuit according to the present invention.

FIGS. 4~6 are diagrams illustrating the operation of the dimming control circuit 150 according to the present invention. FIG. 4 depicts the relationship between the PWM signal $S_{PWM}$ and the dimming signal $S_{DIM}$. FIGS. 5 and 6 depict the relationship between the PWM signal $S_{PWM}$ and the synchronization signal SYNC. In FIG. 5, the operation of the LED lighting device 102 with multiple driving stages (N=2) is depicted for illustrative purpose. In FIG. 6, the operation of the LED lighting device 103 with multiple driving stages (N=2) is depicted for illustrative purpose. The turn-on periods of the LED current $I_{LED}$ are represented by striped regions.

Generally, the dimming signal $S_{DIM}$ is kept at a nominal level $V_{NOM}$ when the LED lighting devices 101~103 are requested to provide full brightness, and the level of the dimming signal $S_{DIM}$ is lowered when the user instructs the LED lighting devices 101~103 to lower its brightness. The PWM signal generator 56 may compare the levels of the dimming signal $S_{DIM}$ with an oscillation signal $S_{OSC}$, thereby outputting the PWM signal $S_{PWM}$ accordingly. In the embodiment depicted in FIG. 4, the PWM signal $S_{PWM}$ is set to a high level $V_H$ when $S_{DIM}>S_{OSC}$, and the PWM signal $S_{PWM}$ is set to a low level $V_L$ when $S_{DIM}<S_{OSC}$. More specifically, the PWM signal $S_{PWM}$ is maintained at a 100% duty cycle when the dimming signal $S_{DIM}$ is at the nominal level $V_{NOM}$, thereby allowing full LED current $I_{LED}$ to provide maximum brightness. Similarly, the PWM signal $S_{PWM}$ is maintained at a 40% duty cycle when the dimming signal $S_{DIM}$ drops to $V_{40}$, thereby allowing the LED current $I_{LED}$ to be turned on only during 40% of a period for lowering the brightness.

During the rising cycle of the rectified AC voltage $V_{AC}$ when $V_{AC}$ becomes higher than the barrier voltage (or cut-in voltage) of the luminescent circuit 120 and the adjustable current source 130, the LED current $I_{LED}$ starts to flow and the feedback voltage $V_{FB}$ established across the detecting circuit 160 ramps up. The comparator 54 is configured to compare the levels of the voltage $V_{FB}$ with a reference voltage $V_{REF2}$, thereby outputting the synchronization signal SYNC accordingly. Upon receiving the synchronization signal SYNC, the PWM signal generator 56 is configured to restart or reset the PWM signal $S_{PWM}$, thereby synchronizing the frequency of the PWM signal $S_{PWM}$ with the frequency of the rectified voltage $V_{AC}$.

In the embodiment depicted in FIG. 5, the comparator 54 is configured to output the synchronization signal SYNC when the feedback voltage $V_{FB}$ associated with the frequency of the rectified voltage $V_{AC}$ exceeds the reference voltage $V_{REF2}$. Upon receiving the synchronization signal SYNC, the PWM signal generator 56 is configured to restart the PWM signal $S_{PWM}$. Therefore, the turn-on periods of the current $I_{LED}$ during each driving cycle may be synchronized at the rising edge, thereby improving the flicker phenomenon.

In the embodiment depicted in FIG. 6, the comparator 54 is configured to output the synchronization signal SYNC when the feedback voltage $V_{FB}$ associated with the rectified voltage $V_{AC}$ drops below the reference voltage $V_{REF2}$. Upon receiving the synchronization signal SYNC, the PWM signal generator 56 is configured to reset the PWM signal $S_{PWM}$. Therefore, the turn-on periods of the current $I_{LED}$ during each driving cycle may be synchronized at the falling edge, thereby improving the flicker phenomenon.

With the above-mentioned dimming control circuit, the present LED lighting device can synchronize the frequency of the PWM signal with the frequency of the rectified voltage $V_{AC}$ so that the turn-on periods of the LED current $I_{LED}$ during each driving cycle may be synchronized. Therefore, the present invention can provide an LED lighting device capable of providing synchronized PWM dimming control without causing flicker or shimmer.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A light-emitting diode (LED) lighting device, comprising:

a luminescent circuit driven by a rectified alternative-current (AC) voltage for providing light according to an LED current;

an adjustable current source configured to vary a duty cycle of the LED current according to a pulsed width modulation (PWM) signal;

a detecting circuit configured to detect a rising edge or a falling edge of the LED current associated with a frequency of the rectified AC voltage; and a dimming control circuit configured to:

generate the PWM signal; and synchronize a frequency of the PWM signal with the frequency of the rectified AC voltage at the detected rising edge or the falling edge of the rectified AC voltage.

2. The LED lighting device of claim 1, wherein the dimming control circuit is further configured to vary a duty cycle of the PWM signal according to a dimming signal.

3. The LED lighting device of claim 1, wherein:

the detecting circuit is further configured to provide a feedback voltage associated with the rising edge or the falling edge of the LED current; and the dimming control circuit includes:

a comparator configured to output a synchronization signal indicative of the rising edge of the LED current when the feedback voltage rises above a reference voltage or output the synchronization signal indicative of the falling edge of the LED current when the feedback voltage drops below the reference voltage; and a PWM signal generator configured to synchronize the frequency of the PWM signal with the frequency of the rectified AC voltage by restarting or resetting the PWM signal when receiving the synchronization signal.

4. The LED lighting device of claim 1, further comprising a driving circuit configured to regulate the LED current flowing through the luminescent circuit in multiple stages.

5. The LED lighting device of claim 4, wherein:

the luminescent circuit includes a plurality of luminescent devices coupled in series; and the driving circuit includes a plurality of current controllers each coupled in parallel to a corresponding luminescent device among the plurality of luminescent devices.

6. The LED lighting device of claim 4, wherein:

the luminescent circuit includes a plurality of luminescent devices coupled in series;

the driving circuit includes a plurality of current controllers; and a first current controller among the plurality of current controllers includes:

a first end coupled to a first end of a first luminescent device among the plurality of luminescent devices;

a second end coupled to a second end of the first luminescent device; and a third end coupled to a first end of a second luminescent device among the plurality of luminescent devices and a first end of a second current controller among the plurality of current controllers.

7. The LED lighting device of claim 6, wherein:

a second end of the second current controller is coupled to a second end of the second luminescent device; and a third end of the second current controller is coupled to the adjustable current source.

8. The LED lighting device of claim 1, wherein the adjustable source includes a transistor switch configured to switch on or switch off the LED current according to a duty cycle of the PWM signal.

9. The LED lighting device of claim 1, further comprising a regulating control circuit configured to generate a regulating signal associated with a variation in the rectified AC voltage, wherein:

the detecting circuit is further configured to detect the variation in the rectified AC voltage; and the adjustable current source is further configured to adjust a value of the LED current according to the regulating signal.

10. The LED lighting device of claim 9, wherein the detecting circuit is further configured to provide a feedback voltage associated with the variation in the rectified AC voltage; and the adjustable current source adjusting the value of the LED current according to the regulating signal includes:

decreasing the value of the LED current when the regulating signal indicates that the feedback voltage exceeds a reference voltage; and increasing the value of the LED current when the regulating signal indicates that the feedback voltage does not exceed the reference voltage.

* * * * *